United States Patent [19]

Petry et al.

[11] Patent Number: 4,580,725

[45] Date of Patent: Apr. 8, 1986

[54] HYDRAULIC MONITOR PROTECTION APPARATUS

[75] Inventors: Eston F. Petry, Barrackville; Kenneth E. McBee, II, Morgantown, both of W. Va.

[73] Assignee: Conoco Inc., Ponca City, Okla.

[21] Appl. No.: 624,155

[22] Filed: Jun. 25, 1984

[51] Int. Cl.[4] ..... B05B 1/28; B05B 15/04

[52] U.S. Cl. ..... 239/288.3; 239/288.5

[58] Field of Search ..... 384/221, 222, 536, 611; 239/288, 288.5, 587, 288.3; 299/17

[56] References Cited

U.S. PATENT DOCUMENTS

| | | | |
|---|---|---|---|
| 2,534,738 | 12/1950 | Scott | 384/536 X |
| 2,865,689 | 12/1958 | Anderson | 384/536 |
| 3,058,790 | 10/1962 | Hammerand | 384/611 X |
| 4,012,076 | 3/1977 | Shoji et al. | 299/17 |
| 4,045,086 | 8/1977 | Parks et al. | 299/17 |

FOREIGN PATENT DOCUMENTS

| | | | |
|---|---|---|---|
| 222072 | 9/1958 | Australia | 239/587 |
| 958724 | 12/1974 | Canada | 262/68 |
| 1505721 | 3/1978 | United Kingdom | 239/587 |

*Primary Examiner*—Andres Kashnikow
*Assistant Examiner*—Mary Beth O. Jones
*Attorney, Agent, or Firm*—William J. Miller

[57] ABSTRACT

A hydraulic monitor barrel is protected from falling debris by attaching to the monitor housing a pair of spaced vertically positioned plates, so that the monitor barrel can moved freely between the plates and yet be protected by the plates from any debris which should fall on the monitor. In addition, the bearing of the monitor is protected by providing a yieldable coupling between the housing and the bearing, so that when vertical forces are applied to the housing, the housing settles against the base of the monitor and transfers the forces thereby from the vertical plates to the monitor base, rather than through the monitor bearing.

3 Claims, 3 Drawing Figures

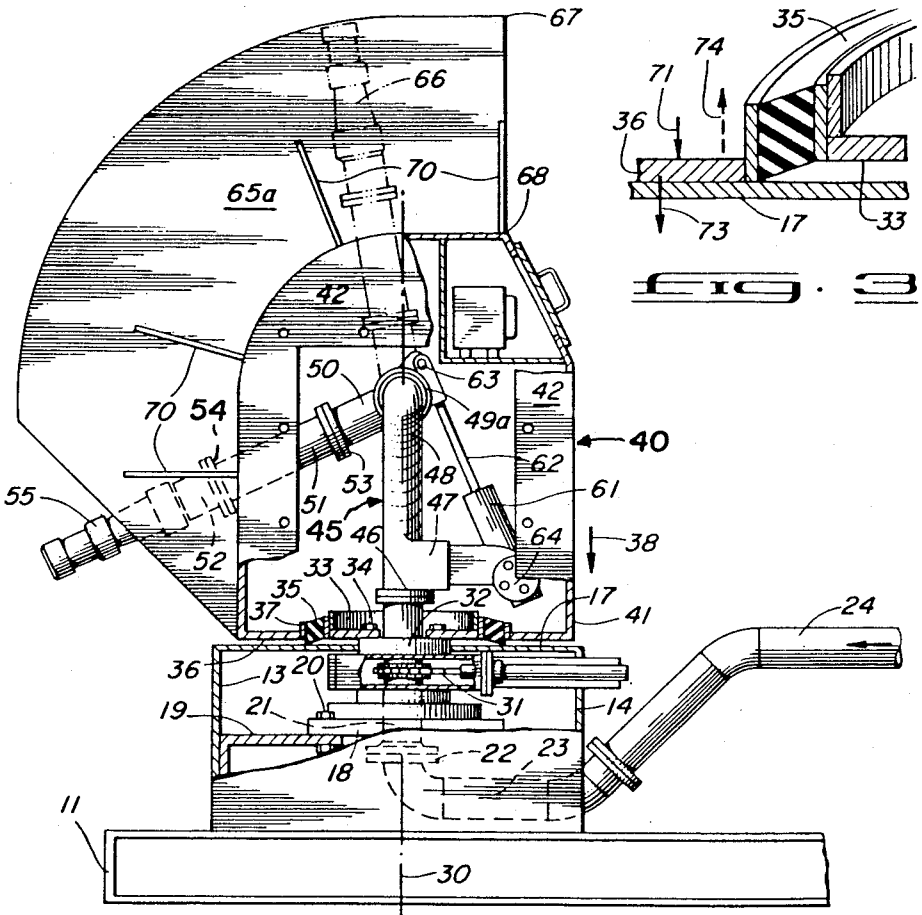
Fig. 3
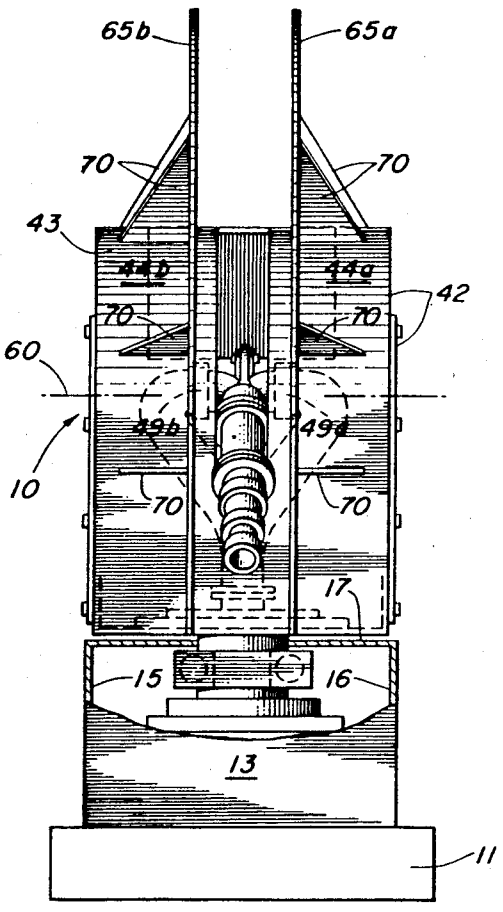
Fig. 2
Fig. 1

HYDRAULIC MONITOR PROTECTION APPARATUS

BRIEF DESCRIPTION OF THE PRIOR ART

The best prior art known to Applicants is Canadian Pat. No. 958,724 issued Dec. 3, 1983, to Yamamoto et al, Tokyo, Japan. In this patent a hydraulic monitor is disclosed with protection to the horizontal axis cylinder which is mounted behind the hydraulic monitor and protection for the vertical axis movement apparatus which is protected by a plate covering the apparatus so that falling debris will not contaminate or damage the vertical movement apparatus. That patent, however, does not disclose any suitable means for protecting the monitor itself, the barrel, the nozzle, or the horizontal or vertical bearings from severe damage if the material falling on the monitor should be of a substantial size.

BRIEF DESCRIPTION OF THE INVENTION

This invention discloses a monitor similar to the previously described apparatus, however, this monitor differs from the previously described apparatus in that it has adequate protection not only for the monitor but also for the bearings supporting the monitor so that heavy material falling onto the monitor will not damage either the monitor, the monitor barrel, or the vertical or horizontal bearings used for moving the monitor during its normal operation.

In accordance with this invention the monitor is constructed having a base with the main water supply pipe attached to the base and to a swivel bearing which provides rotation about a vertical axis. A bearing is provided to support the vertical tube for rotation about the vertical axis. Attached to the vertical tube is a "Y" shaped tube with arms directed toward each other to form a horizontal axis terminating in rotatable couplings which are connected into the monitor barrel. The rotatable couplings permit the rotation of the monitor barrel about a horizontal axis. The monitor barrel terminates in a nozzle. At the rear of the barrel is provided a hydraulic cylinder attached between the vertical tube and the rear portion of the monitor barrel. Likewise, attached to the vertical tube is an apparatus comprising a chain drive attached to the tube itself and a pair of hydraulic cylinders attached to the monitor barrel. Actually, the hydraulic cylinders provide rotation about a vertical axis. In order to protect the bearings from damage from heavy vertical forces such as those caused by heavy material falling onto the monitor during its normal use, a monitor protection scheme is devised which includes two basic concepts. The first concept protects the monitor, barrel and equipment used to move the monitor barrel, and the second concept comprises apparatus for protecting the bearings from severe damage from high vertical forces caused by falling debris impacting the monitor and driving the vertical tube against the bearing causing damage to the bearings of the monitor. The monitor is protected by a housing which is attached through a flange to the vertical tube which couples the main water supply to the monitor barrel base. The housing supports a pair of shields which extend parallel to the monitor barrel and in close proximity to the monitor barrel. The shield extends from the housing a sufficient distance to protect the monitor barrel regardless of the position the barrel is in at the time the material falls onto the monitor. These parallelly spaced shields are protected by fabricating them of heavy material and using reinforcement plates wherever necessary. The bearings are protected by providing the coupling between the housing and the flange through a yieldable member. Underneath the housing is a plate which is attached to the monitor base. Thus, when excessive forces are applied vertically to the monitor, the yieldable member will permit the housing to sink a small but predetermined amount letting the housing then be impacted against the plate attached to the base. Since both the housing and the base can withstand the forces of the impact, the bearings are protected from any severe forces which would normally cause them to be damaged or destroyed.

BRIEF DESCRIPTION OF THE FIGURES

FIG. 1 is an end view of the monitor and monitor base;

FIG. 2 is a side view of the apparatus illustrated in FIG. 1; and

FIG. 3 is a detailed drawing illustrating the cooperation between the center flange, the outer housing, and the plate under the outer housing which protects the bearing from damage when heavy vertical forces are applied to the housing.

DETAILED DESCRIPTION OF THE INVENTION

Referring to all of the drawings but in particular to FIGS. 1 and 2 a monitor 10 is illustrated having a base 11 with vertical plates 13, 14, 15 and 16. Attached to the top edge of plates 13 through 16 is a cover and impact plate 17. Bearings 18 are attached to a plate 19 which is attached to side plate 13 through 16 in any usual manner such as bolts 20. Passing axially through bearing 18 is a vertical tube means 21 which is connected through a rotatable or swivel coupling 22 to a pipe 23 which is coupled through pipe 24 to a main water supply (not illustrated). Movement about vertical axis 30 is provided by an apparatus including a hydraulic cylinder means and chain drive generally referred to by arrow 31. A flange means 32 is attached to vertical pipe 21 in any usual manner. Attached to flange 32 is a second cup-shaped flange 33 which is attached to flange 32 by bolts 34, for example. Surrounding cup-shaped flange 33 is a ring of yieldable material 35 which is vulcanized onto cup-shaped flange 33 at its perimeter in any well known method. Yieldable material 35 can be rubber or plastic or any other yieldable substance. Yieldable material 35 is also attached to a base 36 at a ring portion 37 in the same manner as it is attached to cup-shaped flange 33 so that cup-shaped flange 33, yieldable material 35 and housing base 36 will all form a unitary structure which is rigid in every direction but the vertical and in that direction it will move in the direction of arrow 38 if placed under severe compression. A housing referred to by arrow 40 comprises a back plate 41, side plate 42 and 43 and a front plate portion **44*a* and 44*b*. The monitor pipe 45 is attached to tube 21 through a flange 46 and essentially comprises a base support 47, a "Y"-shaped branch 48 and rotatable couplings 49*a* and 49*b*. The base 50 of monitor 45 is attached to the rotatable couplings 49*a* and 49*b* for the input of the fluids into the monitor and to the monitor barrel parts 51 and 52 which are all attached to the monitor base 50 through the couplings 53 and 54, respectively. A nozzle 55 is attached to monitor barrel part 52 at its end. Vertical movement about a horizontal axis 60 is accomplished by hydraulic cylinder 61 and its corresponding hydraulic shaft 62 which is coupled to monitor base 50 at pivot 63 at one end and to monitor base support means 47 through a coupling 64 at its other end. The hydraulic control lines for cylinder 61** are not illustrated and their coupling and method of use are obvious to those skilled in the art.

Attached to front plate 44*a* and 44*b* are shield plates 65*a* and 65*b*. The height of shield plates 65*a* and 65*b* are determined by the total length of the monitor barrel as illustrated in the dotted monitor barrel position 66. Thus the distance 67 to 68 is determined by the total length of the monitor from its vertical axis 60 to the top of its nozzle 55. This distance 67 must be adequate to protect the nozzle if the nozzle is in the up position as illustrated by 66 from vertical impact of vertical material falling on the monitor. A plurality of strengthening members 70 are welded or attached by other usual means between shields 65*a* and 65*b* and housing front plates 44*a* and 44*b*. These plates tend to strengthen the shield and prevent deflection of the shield when heavy forces are dropped or applied to the shield.

OPERATION

It was previously described that protection of the monitor falls in two distinct categories. The first feature this invention includes is protection of the barrel of the monitor from falling debris. The reason monitor barrels are built in sections 50, 51 and 52 with nozzle 55 separate, for example, is because falling debris tends to break the nozzle off at various joints. The separate portion of the barrel provides easy repair to the monitor once the debris has been removed. Such repair, however, becomes costly and expensive and furthermore the monitor cannot be used to clear the debris itself if the nozzle is damaged or the barrel is broken or bent. In order to protect the barrel, a housing referred to by arrow 40 was constructed around the monitor itself. The housing was made sufficiently strong through its side walls 42, 43, 44*a*, 44*b* and 41 to protect substantially all of the monitor against heavy vertical impact caused by falling debris. The nozzle, however, must, likewise, be protected along with the barrel of the monitor, regardless of the position of the barrel during its use. In order to accomplish the above, shields 65*a* and 65*b* were mounted onto the housing 40 by welding or any other usual means.

From the above it can be seen that the monitor is clearly protected from forces which would normally damage or destroy the monitor itself or the associated equipment used to move the monitor, such as, for example, the hydraulic cylinder 61, cylinder rod 62, and pivot 63 and 44.

The second protection feature this invention includes is means for protecting the bearings 18, 32, and swivel couplings 22 along with swivel couplings 49*a* and 49*b* from damage due to vertical impact. Even if the monitor barrel itself is protected from vertical impact, downward thrust on the housing would cause severe damage to the bearing and associated apparatus since all of the elements coupling the pipe 23 to the monitor base 50 are rigid. In order to protect these elements from severe damage the housing 40 is designed to take all of the vertical load by the falling debris rather than the delicate bearings and operating equipment inside the housing. To accomplish the above and yet provide freedom of the monitor during use, a unique system was designed to permit the housing to be free for rotation during its normal use and yet provide adequate protection for forces applied vertically to the housing during roof or impact situations. To accomplish the above base 36 of housing 40 was placed in close proximity to the cover and impact plate 17. A yieldable material 35 was coupled between base or bottom of housing 36 and the cup-shaped flange 33 and flange 32 is rigidly attached to vertical tube means 21.

The system can be clearly illustrated by referring to FIG. 3. It can be seen that the plate 36 of FIG. 2 has a substantial distance between it and the cover and impact plate 17. When a heavy vertical force is applied in the direction of arrow 71 (see FIG. 3) plate 36 will move in the direction of arrow 73 causing plate 35 to impact plate 17. Plate 17 is of sufficient strength that it can take all of the impact forces applied to the housing 40. Once the material has been removed from the monitor the resiliency of material 35 will cause the plate to return in the direction of arrow 74 to its original position as shown in FIG. 2. The apparatus is then ready to freely rotate in the same manner as disclosed previous to the impact.

One important feature of this invention is the cooperation between shield plates 65*a* and 65*b* and the assembly comprising elements 33, 35, and 36. Shield plates 65*a* and 65*b* provide a suitable impact location for falling debris so that none of the monitor is damaged by the impact, therefore, shield plates 65*a* and 65*b* not only protect the monitor barrel in position 66 but also provide a suitable means for transferring the forces due to impact to the housing through plates 68, 42 and 43 to the plate 36 which then transfers the impact forces to plate 17.

CONCLUSIONS

An apparatus has been disclosed which provides significant protection to a monitor barrel and its associated equipment used to move it both vertically and horizontally including the bearings necessary for providing the movement, particularly during impact created by falling debris striking the monitor as a consequence of a roof fall.

It is obvious that changes can be made in the application and still be within the spirit and scope of the invention as disclosed in the specification and appended claims.

What is claimed is:

1. Apparatus for the protection of a hydraulic monitor from falling debris, said hydraulic monitor including a base, a main water supply pipe, a bearing means having a vertical pipe means attached therethrough, a rotatable joint coupling said main water supply pipe to said vertical pipe, a monitor barrel, and a second rotatable joint means coupling said monitor barrel to said vertical pipe means in a manner to permit movement of said monitor about a horizontal axis, an improvement comprising:

a. a housing means;

b. means attaching said housing means to said vertical pipe means, said housing means extending on each side of said vertical pipe means and spaced to permit free arcuate movement of said monitor about said horizontal axis; and c. shield means mounted to each of said housing means and extending substantially vertically from said housing means a distance at least as long as the barrel length of said monitor means, whereby material impacting said monitor will strike said shield means rather than said monitor barrel or said rotatable joint means.

2. Apparatus as described in claim 1 having bearing protection means including flange means attached to said vertical pipe means and wherein said means attaching said housing means to said pipe means is yieldable to vertical forces and impact plate means mounted below said housing means and attached to said base means whereby vertical forces impinging on said housing means will cause said housing means to press against said impact plate means, thereby preventing excessive forces from being transferred to said barrel means.

3. Apparatus for the protection of a hydraulic monitor against falling debris comprising a base, a vertical pipe means, a main water supply means, a bearing means attached to said base and having a rotatable coupling attached between said vertical pipe means and said water supply means, housing means, flange means attached to said vertical pipe means, yieldable means attaching said flange means to said housing means, plate means mounted to said base means below said housing means and spaced to permit free rotation of said housing means, monitor means attached to said vertical pipe means, said attachment including a swivel coupling, thereby permitting movement of said monitor means about a horizontal axis of said swivel coupling means, monitor barrel means attached to said monitor, said barrel means including a nozzle means, shield means attached to said housing means and spaced on each side of said barrel means in a manner to permit free movement of said monitor barrel means about said horizontal swivel coupling means, said shield extending a distance equal to or greater than the length of said monitor means throughout the full axial movement of said monitor means whereby falling debris, having substantial weight, striking said monitor will first strike said shield means thereby protecting said monitor means and said barrel means, said weight deforming said yieldable means causing said yieldable means to press against said plate means thereby preventing excessive forces from being transferred to said monitor means.

* * * * *